US007770766B2

(12) United States Patent
Foissac et al.

(10) Patent No.: US 7,770,766 B2
(45) Date of Patent: Aug. 10, 2010

(54) RUCKSACK WITH A BELT ASSEMBLY ENABLING ANGULAR PIVOTING

(75) Inventors: Matthieu Foissac, Lille (FR); Antoine Lafoux, Magland (FR)

(73) Assignee: Decathlon, Villeneuve d'Ascq (FR)

( * ) Notice: Subject to any disclaimer, the term of this patent is extended or adjusted under 35 U.S.C. 154(b) by 1031 days.

(21) Appl. No.: 10/567,454

(22) PCT Filed: Aug. 11, 2004

(86) PCT No.: PCT/FR2004/002133

§ 371 (c)(1),
(2), (4) Date: Aug. 14, 2006

(87) PCT Pub. No.: WO2005/016066

PCT Pub. Date: Feb. 24, 2005

(65) Prior Publication Data

US 2008/0164293 A1 Jul. 10, 2008

(30) Foreign Application Priority Data

Aug. 12, 2003 (FR) ..... 03 09856

(51) Int. Cl.
*A45F 3/08* (2006.01)
*A45F 3/04* (2006.01)

(52) U.S. Cl. ..... 224/262; 224/633; 224/637; 224/662; 224/628

(58) Field of Classification Search ..... 224/633, 224/637, 642, 662, 663, 628, 262, 634, 636
See application file for complete search history.

(56) References Cited

U.S. PATENT DOCUMENTS 204,066 A * 5/1878 Merriam ..... 224/154
3,923,216 A * 12/1975 Farnbach ..... 224/636
4,049,164 A * 9/1977 Sullivan et al. ..... 224/633
4,982,884 A * 1/1991 Wise ..... 224/634
5,236,112 A * 8/1993 Robinson et al. ..... 224/630
5,609,278 A * 3/1997 Fresco ..... 224/153
5,725,139 A 3/1998 Smith
5,732,867 A * 3/1998 Perkins et al. ..... 224/628
5,823,414 A * 10/1998 Gal et al. ..... 224/637
6,276,584 B1 8/2001 McLachlan
6,290,114 B1 * 9/2001 Berberian ..... 224/642

(Continued)

FOREIGN PATENT DOCUMENTS

CA 476398 A * 8/1951

(Continued)

*Primary Examiner*—Nathan J Newhouse
*Assistant Examiner*—John Cogill
(74) *Attorney, Agent, or Firm*—Kenyon & Kenyon LLP

(57) ABSTRACT

A rucksack comprising a bag having a back panel and, among other things, a belt assembly and a rigid frame secured to the back panel and the belt assembly. According to the invention, the bottom portion of the rigid frame has a V-shaped configuration with an angle α at the apex, and in its middle and rear portion, the belt assembly includes an upwardly open pocket having a V-shaped configuration with an angle β at the apex, where β is greater than α, such that said pocket is suitable for serving as a housing for receiving the V-shaped bottom portion of the frame while allowing the belt assembly to pivot angularly to some extent relative to the remainder of the rucksack.

20 Claims, 3 Drawing Sheets

U.S. PATENT DOCUMENTS 6,634,533 B2 * 10/2003 Thompson et al. ..... 224/641
6,892,915 B2 * 5/2005 Mares ..... 224/630

FOREIGN PATENT DOCUMENTS

FR 2 333 464 7/1977
FR 2700677 A1 * 7/1994
WO WO 9105494 A1 * 5/1991

* cited by examiner

RUCKSACK WITH A BELT ASSEMBLY ENABLING ANGULAR PIVOTING

This is a 371 national phase application of PCT/FR2004/002133 filed 11 Aug. 2004, claiming priority to French Patent Application No. 0309856 filed 12 Aug. 2003, the contents of which are incorporated herein by reference.

The present invention relates to an improved rucksack suitable for adapting to the movements of a moving user by the rucksack having a belt assembly that is capable of pivoting angularly relative to the back of the rucksack.

The manufacturers of rucksacks are always seeking to improve user comfort, including when carrying heavy loads.

It has been found that it is appropriate to avoid carrying the loads contained in the rucksack solely on the user's shoulders via shoulder straps, and instead to distribute the load as evenly as possible, and in particular by transferring a large portion thereof to the lumbar portion of the user's back.

For this purpose, with a rucksack having a set of shoulder straps and a belt assembly together with a rigid frame placed between said shoulder straps and said belt assembly, such a transfer of the load is obtained by causing the rigid frame to be supported by the belt assembly.

An improvement in user comfort can also be obtained by allowing for a certain amount of angular pivoting between the sack proper and the shoulder straps or the belt assembly. Under such circumstances, the shoulder straps and/or the belt assembly can follow the natural movements of the moving user's body and leave the sack proper together with its load in substantially the same position.

This ability of the belt assembly to pivot angularly is particularly advantageous when load is transferred to said belt assembly.

Such a concept is known from document FR 2 739 004 which provides for the belt assembly to be connected to the panel forming the back face of the rucksack, i.e. the face that comes into contact with the user's back, in such a manner as to enable the belt assembly to pivot through a limited angle relative to the sack proper, in plane parallel to the panel, and about a horizontal axis extending transversely relative to the panel.

The example described and shown in that prior document relates to a rucksack whose rigid frame is constituted by two uprights constituting two parallel metal bars that are spaced apart from each other. The top portion of each bar is secured to the back panel of the rucksack and the bottom portion to the belt assembly. More precisely, that is done by engaging the corresponding ends of each bar in a kind of sheath whose internal recess forms a U-shape suitable for receiving the end of the bar. In order to make the desired angular pivoting possible, the width of the internal recess in each sheath fitted to the belt assembly is greater in a plane extending transversely to the back panel than the width of the corresponding upright. This angular pivoting of the belt assembly thus engages both uprights simultaneously, like a deformable parallelogram, and that leads to a change in the relative heights of the two uprights. To accommodate this variation in height, document FR 2 739 004 provides for the sheaths holding the uprights to the back panel should be made of elastic material. The solution described as an embodiment in that document has been found not to be optimal, in particular because the movements of the two uprights constituting the rigid frame during angular pivoting movement of the belt assembly are impeded in part when the rucksack is carrying a heavy load.

The present invention mitigates the drawbacks presented by that embodiment, while maintaining the principle of the angular pivoting of the belt assembly as recommended by document FR 2 739 004.

The rucksack in question comprises in conventional manner a sack proper with a back panel, and amongst other things a belt assembly and a rigid frame secured to the back panel and to the belt assembly.

According to the invention, in characteristic manner, the bottom portion of the rigid frame has a V-shaped configuration with an angle $\alpha$ at the apex, and in its middle and rear portion, the belt assembly includes an upwardly open pocket having a V-shaped configuration with an angle $\beta$ at the apex, where $\beta$ is greater than $\alpha$, such that said pocket is suitable for serving as a housing for receiving the V-shaped bottom portion of the frame while allowing the belt assembly to pivot angularly to some extent relative to the remainder of the rucksack.

Thus, using this particular disposition of the invention, there is only one location where the rigid frame is secured to the belt assembly, and that is constituted by the V-shaped pocket. When the belt is assembly is in its central position the bottom portion of the V-shape of the frame lies within said pocket between two empty portions, each occupying an angle equal to half the difference between $\beta$ and $\alpha$. Thus, the capacity for angular pivoting on either side of the vertical axis of the rucksack, corresponding to the axis of symmetry DD' of the V-shaped bottom portion of the frame, corresponds to the value $\frac{1}{2}(\beta-\alpha)$. For greater angles, one of the limbs of the V-shape comes into abutment against the inside wall of the pocket and further pivoting of the belt assembly is prevented.

In a variant embodiment, the rigid frame, at least in its V-shaped bottom portion, is constituted by a flat bar of small thickness, and the pocket is a flat pocket applied onto the rear face of the belt assembly, in particular by stitches. There is thus no particular extra thickness because of the presence of the frame, as would otherwise happen if the pocket used were to be made as a molding of plastics material, having a larger inside space.

Preferably, the bottom end of the frame, forming the V-shaped point, is rounded in shape and the bottom of the pocket includes a reinforced zone facing said point. It is through this zone that all the transfer of weight from the rucksack to the belt assembly takes place. The rounded shape of its point thus enables it to accompany the angular pivoting and limits wear at the bottom of the pocket.

In a variant embodiment, the middle portion of the belt assembly includes a V-shaped stiffening plate constituting the inside wall of the pocket, said stiffening plate preferably having a surface state with a low coefficient of friction relative to the material constituting the V-shaped bottom portion of the frame. The purpose of these two structural dispositions is to avoid impeding the desired angular pivoting by avoiding any braking of this pivoting, as could occur by folds forming or by having a surface state that is too rough between the frame and the inside of the pocket.

It is conceivable for there to be no secure fastening between the belt assembly and the remainder of the rucksack, insofar as these two portions are necessarily held together by the load in the rucksack naturally being transferred via the frame into the pocket of the belt assembly. It would thus be possible for the user to begin by putting on the belt assembly, and then putting on the remainder of the rucksack, possibly with the help of a third party, introducing the bottom portion of the frame into the pocket in the belt assembly and putting the arms through the shoulder straps. A priori, there would be no drawback in having no secure fastening while the rucksack is in normal use on the user's back. Nevertheless, in a variant embodiment, the rucksack includes releasable fastening means to hold the belt assembly to the back of the rucksack or to the frame, thus making it possible in the inactive position to insert the bottom portion of the frame into the V-shaped pocket, and in the active position to secure the belt assembly to the back or to the frame of the rucksack, but without impeding the capacity of the belt assembly to pivot angularly.

Such fastener means could be constituted in particular by a flexible strip having one end secured, in particular by stitching, to the bottom edge of the back of the rucksack in a middle portion thereof, and that is suitable for being secured in releasable manner, in particular by self-gripping means of the hook and loop type, to the front face of the belt assembly after said bottom portion of the frame has been put into the V-shaped pocket. During angular pivoting of the belt assembly, the flexible strap deforms slightly, but that does not significantly impede said angular pivoting.

In a variant embodiment, the rucksack includes two sets of padding means, and in particular:

- a first set constituted by two side pads of the belt assembly disposed on either side of the front wall of the V-shaped pocket, and in particular on either side of its stiffener plate, the inside edges of the two side pads defining a substantially V-shaped space; and
- a second set constituted by a central pad that is substantially V-shaped, with its bottom portion secured, in particular by stitches, to the bottom edge of the back of the rucksack, said central pad being suitable for engaging in the V-shaped space between the two side pads and including releasable fastener means, in particular self-gripping means, for securing it to the back of the rucksack.

In a variant embodiment, the means for passing the central pad comprise a longitudinal strip extending said central pad and a downwardly-open longitudinal sheath secured to the back of the rucksack and suitable for receiving the longitudinal strip which can be secured releasably to one of the inside faces of said sheath, in particular by self-gripping means.

The present invention can be better understood on reading the following description of a preferred embodiment of a rucksack in which the load is taken up by the belt assembly, which assembly has the ability to pivot angularly, and is shown in the accompanying drawings, in which.

Figure 2:
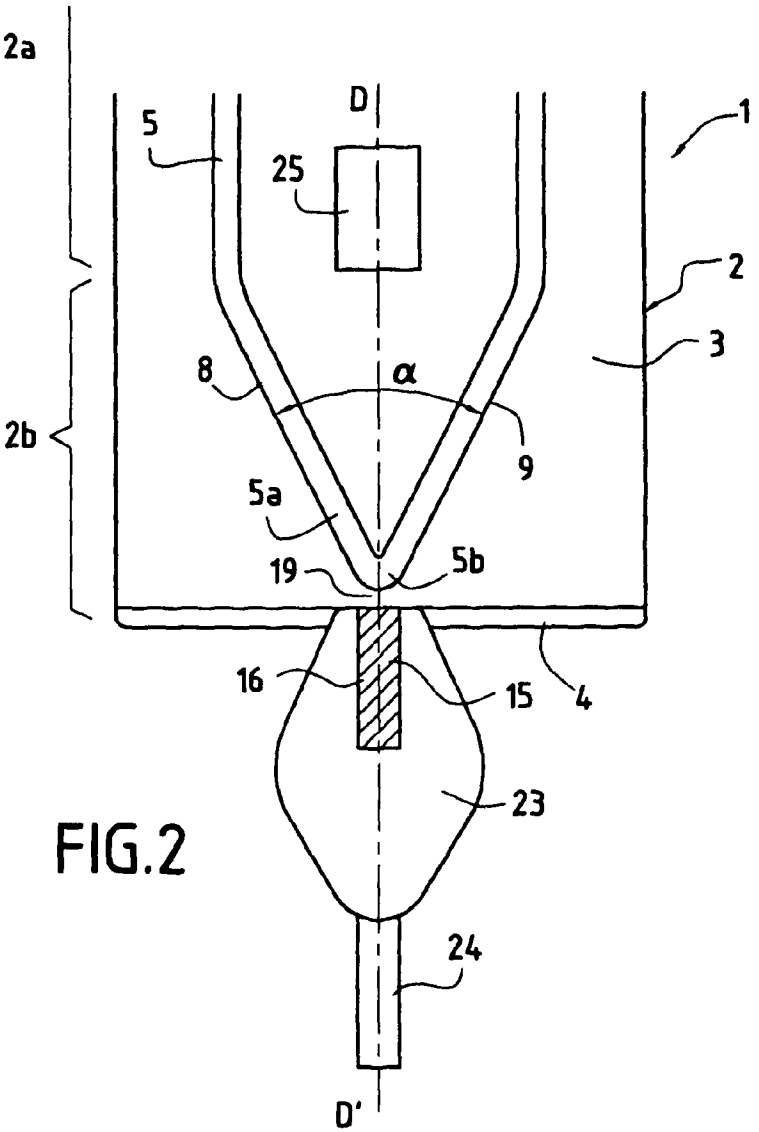
FIG. 2 is a fragmentary view similar to FIG. 1, after the belt assembly has been removed.

The rucksack 1 described below comprises in conventional manner a bag or sack proper 2, which in the figures is represented solely by its back panel, referred to below as the "back" 3, together with a small portion of its bottom 4. It also comprises a rigid frame 5, a set of shoulder straps (not shown) to enable the rucksack to be carried on the shoulders of the user, and a belt assembly 6 enabling the rucksack to be held around the user's waist and also enabling its weight to be taken up at lumbar level.

As can be seen more clearly in FIG. 2, the rigid frame 5 has a configuration that is entirely special in that its bottom portion terminates in a V-shaped configuration.

In the example shown in non-exclusive manner, the frame 5 is made up of two metal bars, in particular aluminum bars, which are parallel in the upper portion la of the rucksack and which, in the lower portion 2*b*, converge towards each other so as to be united, in particular by welding, thus giving the frame 5 its V-shaped bottom portion 5*a*.

The bottom end corresponding to the point 5*b* of the V-shape is preferably rounded.

The V-shaped configuration of the bottom portion 5*a* of the frame 5 forms an angle $\alpha$ at the apex, where the value of the angle $\alpha$ is measured between the furthest-apart edges 8 and 9 of the frame 5.

The point 5*b* of the frame 5 is located close to the bottom edge 7 of the back 3 of the rucksack when the rucksack is in its normal configuration.

Figure 3:
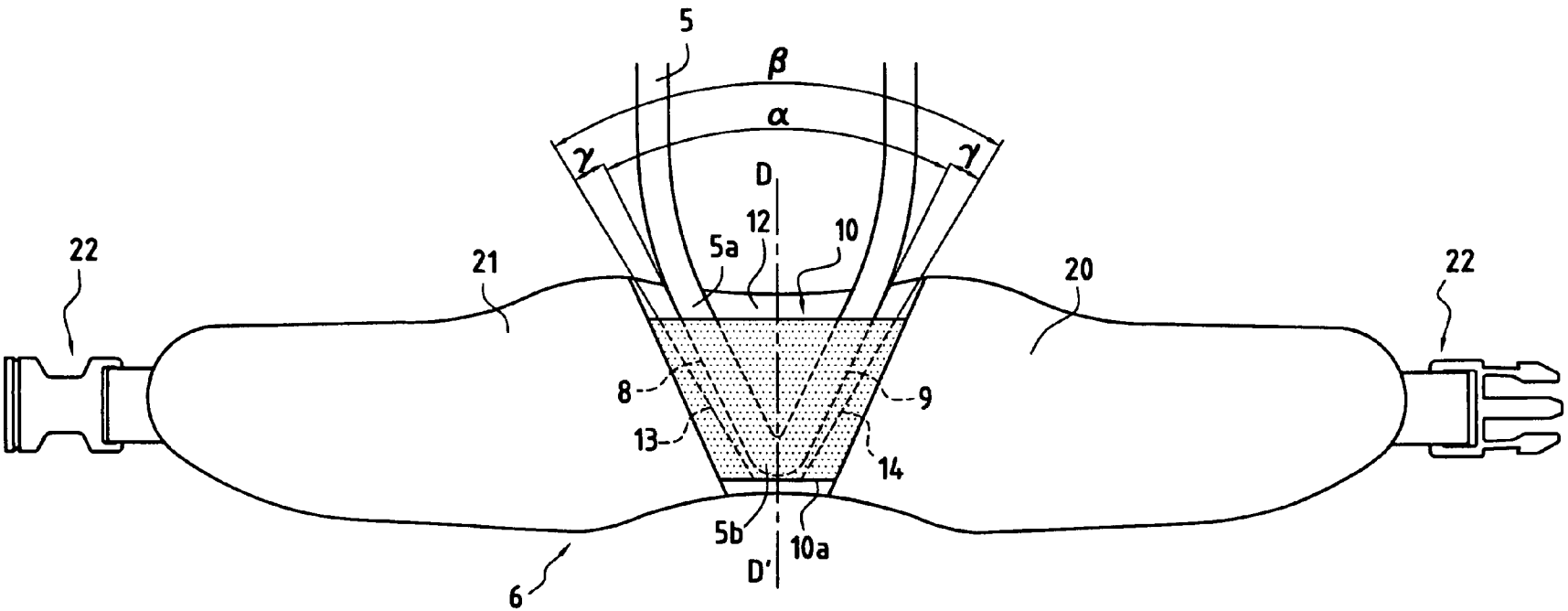
FIG. 3 is an overall view of the belt with a central pocket into which the V-shaped bottom portion of the frame is inserted.

FIG. 3 is a back view of the belt assembly 6, i.e. the face that is visible in the view is the face that comes into contact with the back 3 of the rucksack when assembled thereto. In its center, symmetrically about the axis DD', the belt assembly 6 has a back pocket 10 with its opening 11 facing upwards. The back pocket 10 has a V-shaped configuration with an angle $\beta$ at the apex, where the angle $\beta$ is greater than the above-mentioned angle $\alpha$.

In an embodiment, the pocket 10 is a flat pocket obtained by stitching one or more patches onto the back face 12 of the belt assembly 6. It can be understood that the back face 12 having the pocket 10 applied thereto must present a plane surface so as to avoid interfering with angular pivoting of the bottom portion 5*a* of the pocket 5 when it is inserted into the pocket 10, as shown in FIG. 3. Also preferably, in order to avoid interfering with this angular pivoting, the rear face 12 of the belt assembly 6 has a surface state presenting a low coefficient of friction relative to the material constituting the bottom portion 5*a* of the frame 5, for example when making the pocket 10, a sheet of smooth plastics material can be applied to the rear face 12. In addition, the V-shaped middle portion of the belt assembly in register with the pocket 10 may advantageously include a stiffening plate. The bottom 10*a* of the pocket 10 may also be reinforced by any appropriate means.

In FIG. 3, there can be seen the bottom portion 5*a* of the frame 5 after it has been inserted into the pocket 10, this insertion being carried out centrally relative to the axis DD'. This insertion does not lead to any particular difficulty, and in particular it is made easier by the point 5*b* sliding against the rear face 12 of the belt assembly that presents an improved surface state.

In the centered position as shown in FIG. 3, the furthest-apart edges 8 and 9 of the bottom portion 5*a* of the frame 5 are spaced apart from the inside side edges 13 and 14 of the pocket 10 by an angle $\gamma$ that is equal to $\frac{1}{2}(\beta-\alpha)$, where this angle $\gamma$ corresponds to the capacity of the belt assembly 6 to pivot angularly on either side of the axis of symmetry DD'. If the movement that occurs when the user is moving corresponds to pivoting through an angle greater than $\gamma$, then the corresponding inside edge 13, 14 of the pocket 10 will come into contact against the edge 8, 9 of the frame and thus prevent it from pivoting more than the angle $\gamma$, thereby applying stress to the rucksack 1. Consequently, it is important for the manufacturer to determine accurately the value of the angle $\gamma$ as a function of the type of rucksack and its use.

An advantage of the invention lies in the ease with which the same rucksack can be associated with belt assemblies 6 having pockets in which the angle $\beta$ takes on different values, or indeed frames 5 having bottom portions with angles α of different values, as a function of different potential uses.

In the example shown, means are shown for securing the belt assembly 6 to the back 3 of the rucksack. Nevertheless, it should be understood that logically speaking such fastening is not strictly necessary while the rucksack is in use insofar as the load of the frame 5 being carried by the bottom 10*a* of the pocket 10 of the belt assembly 6 naturally ensures that the rucksack and the belt are kept together.

More precisely, in the example shown, the fastening means are constituted by a flexible strip 15 and by self-gripping fastener elements of the hook and loop type. The flexible strip 15 has one end that is secured, in particular by stitching, to the bottom edge 7 of the back 3 of the rucksack at the junction between the back 3 and the bottom 4, in a position that is centered relative to the axis DD'. This strip 15 carries self-gripping elements, e.g. loops 16 on its face that can be seen in FIG. 2. The front face 17 of the middle portion of the belt assembly 6 includes self-gripping elements, hooks 18 in the example described, enabling the flexible strip 15 to be secured releasably against said front face 17 by folding said flexible strip 15 about the line 19 where it is secured to the bottom edge 7 of the back 3 of the rucksack. Thus, after the bottom portion 5*a* of the frame 5 has been inserted into the back pocket 10 of the belt assembly 6, it suffices for the user to fold the flexible strip 15 and secure it against the front face 17 of the belt assembly 6 by the self-gripping elements 16, 18 engaging mutually. The fact that this fastening is implemented using a flexible strip 15 does not interfere with the ability of the belt assembly to pivot relative to the frame 5, since the strip can deform without significant resistance during such pivoting.

In the example shown, at the user's lumbar level, the rucksack 1 includes two sets of padding means, specifically a first set constituted by two side pads of the belt assembly, and a second set constituted by a central pad secured to the back of the rucksack and suitable for being received between the two side pads of the belt assembly once said belt assembly has received the bottom portion of the frame.

More precisely, the belt assembly 6 includes, on either side of the central zone in which the pocket 10 is located, two pads 20, 21 of conventional structure, each terminated by buckle fittings 22 for closing the belt assembly around the user's waist, generally by co-operating in snap-fastening. This embedding of the central pad 23 between the two side pads 20, 21 can clearly be seen in FIG. 1. The central pad 23 is secured, in particular by stitching, to the bottom edge 7 of the back 3 of the rucksack, centrally and in particular beneath the flexible strip 5, as can be seen in FIG. 2. To obtain the interfitting shown in FIG. 1, the central pad 23 has a portion close to the bottom edge 7 of the back 3 that is substantially of trapezoidal shape, suitable for pressing into the space defined between the two side pads 20, 21. In the example shown, the central pad 23 is generally lozenge-shaped. It could be of some other shape.

Figure 1:
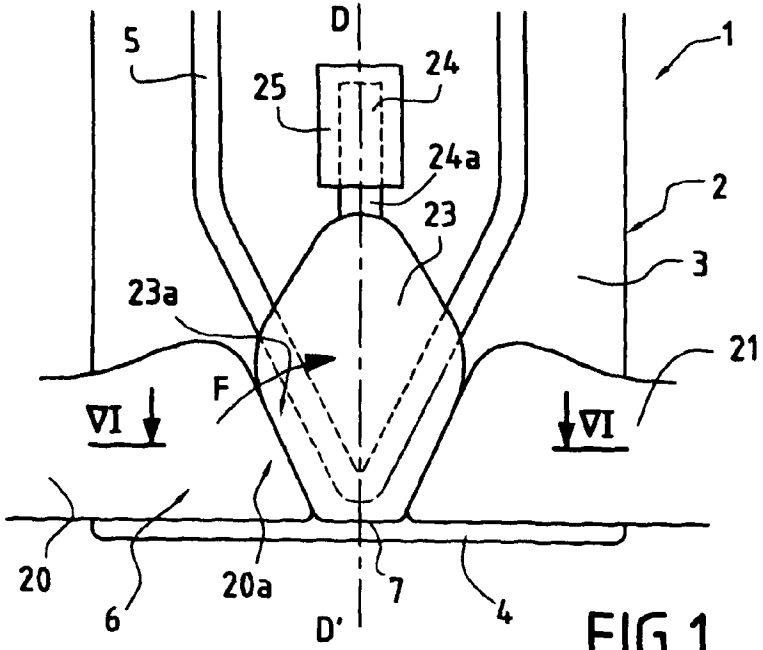
FIG. 1 is a fragmentary elevation view of the back of a rucksack, showing mainly the rigid frame whose bottom portion is V-shaped, and also the belt assembly.
Figure 6:
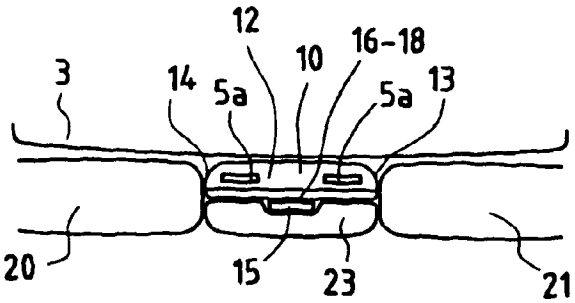
FIG. 6 is a fragmentary cross-section of the FIG. 1 rucksack on line VI-VI.
Figure 5:
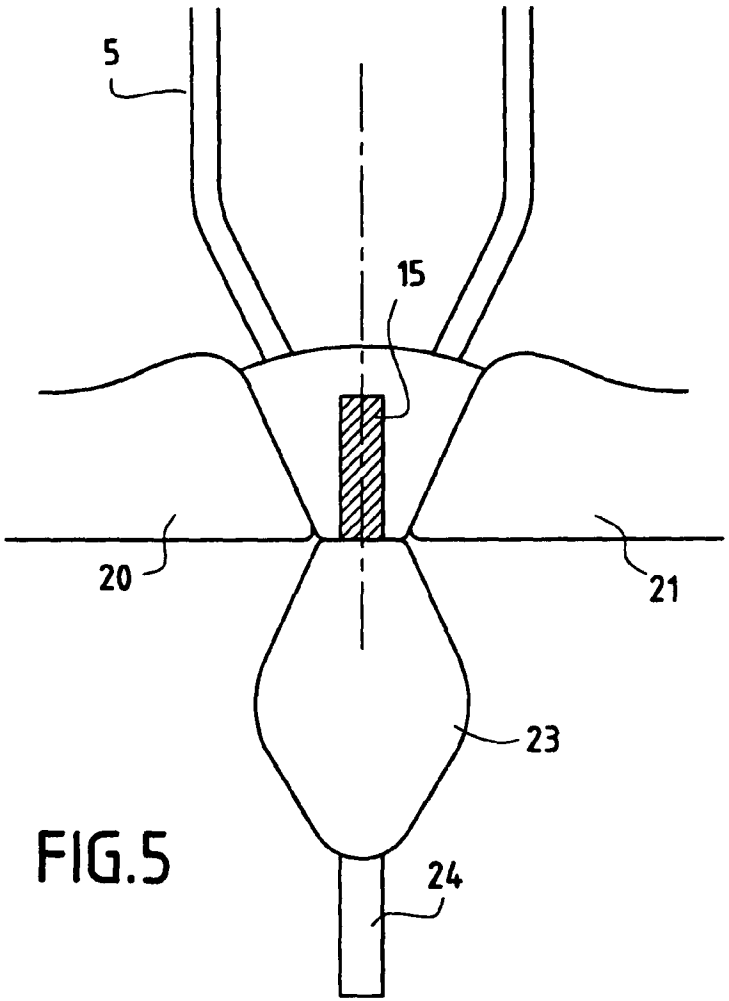
FIGS. 4 and 5 show intermediate steps enabling the belt assembly to be secured to the rucksack.
Figure 4:
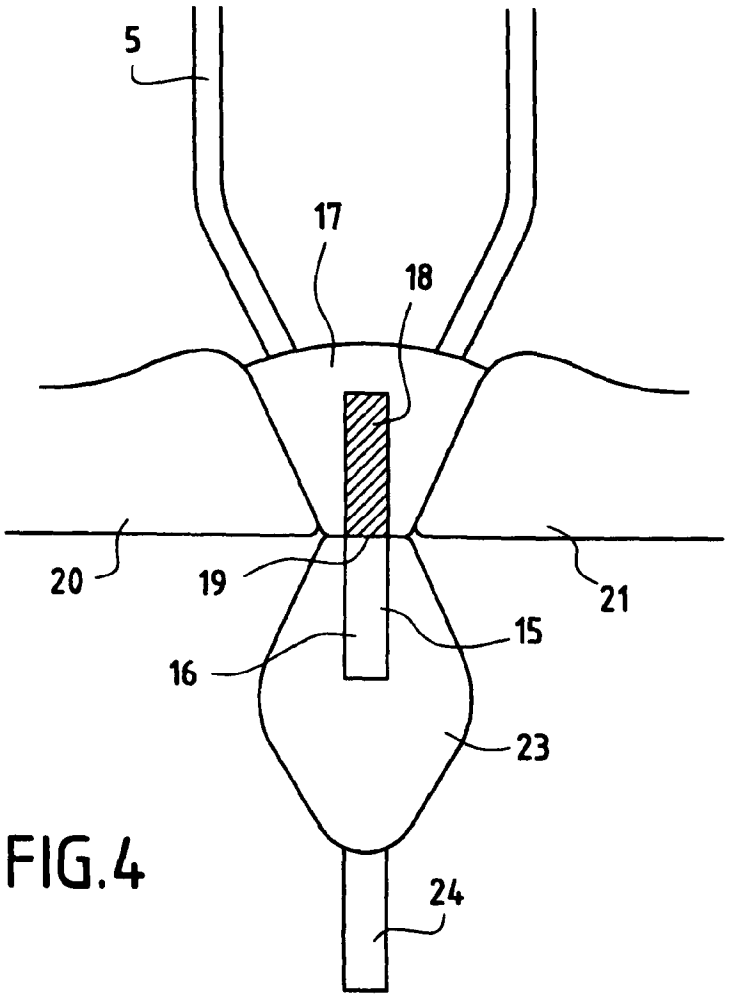

This central pad 23 is fitted with means for securing it to the back 3 of the rucksack, e.g. constituted by a flexible strip 24 extending said pad 23 longitudinally, said strip being fitted with self-gripping elements, e.g. loops, on its rear face 24*a* that is not visible in FIGS. 2, 4, and 5, and that can be seen in part in FIG. 1.

The strip 24 is secured of the back of the rucksack via self-gripping elements, in particular of the hook type placed on the inside face of a sheath 25 secured longitudinally to the back 3 of the rucksack and inside which the strip 24 can be received.

Once the bottom portion 5*a* of the frame 5 has been inserted into the pocket 10 of the belt assembly, and once said belt assembly 6 has been secured to the back of the rucksack by folding the strip 15 so as to cause the self-gripping elements 16 and 18 to co-operate, the user then folds the central pad 23 so that it becomes interfitted between the two side pads 20 and 21 and secures said pad 23 to the back of the rucksack by causing the strip 24 to penetrate into the sheath 25 so as to obtain co-operation between the self-gripping elements carried by the strip 24 and the corresponding inside face of the sheath 25. Naturally, it is also be possible to place self-gripping elements directly on the back of the rucksack, but they could become accidentally separated much more easily in such a configuration than when they are located in the sheath as described and shown. The sheath serves to protect the self-gripping elements, making it essential for the user to act manually in order to separate the central pad from the back of the rucksack.

The presence of the central pad 23 between the two side pads 20, 21 is not strictly necessary since the belt assembly could have a single continuous pad over its entire length, particularly when there are no means for securing the belt assembly to the back of the rucksack. It would suffice to form a zone on the rear face of the belt assembly in its middle portion that is suitable for having the pocket 10 integrated therein as described above, preferably with a stiffener plate constituting the inside wall of said pocket. Under such circumstances, the other face of the stiffener plate is covered by said continuous pad.

When the belt assembly 6 is secured by means of a flexible strip 15 as described above, it suffices for the front face of the belt assembly to have a space formed thereon including the co-operating element, in particular the self-gripping elements, for holding the flexible strip in order to achieve the fastening in question. Under such circumstances, the two side pads 20 and 21 could be extended so as to minimize the width of this space.

The presence of the central pad 23 as described above presents a particular advantage insofar as it enables a damping phenomenon to be established during angular pivoting of the belt assembly relative to the rucksack. With reference to FIG. 1, it can be seen that the two side pads 20 and 21 are in contact or practically in contact with the central pad 23 when the belt assembly 6 is in a centered position relative to the axis DD'. During angular pivoting of the belt assembly 20, e.g. in the direction of arrow F in FIG. 1, then the contacting zones 20*a* and 23*a* of the side pad 20 and of the central pad 23 are flattened to some extent. This limits but not does prevent the belt assembly 6 pivoting angularly. In these zones that are liable to become flattened, it is therefore important for the pads, or at least one of the two pads that come into contact, to be locally free of any stiffening element that could impede such flattening and constitute an obstacle to the angular pivoting. Furthermore, the padding material, in particular foam, making up the pads should be chosen accordingly.

The present invention is not restricted to the specific embodiment described above by way of non-exhaustive example. In particular, the belt assembly could be secured to the back of the rucksack by means other than a flexible strip with self-gripping elements. In particular, it could be achieved by means of a snap-fastening system on the bottom portion of the frame, operating about a pivot axis extending perpendicularly to the plane of the back of the rucksack.

The invention claimed is:

1. A rucksack comprising a bag having a back panel, a belt assembly and a rigid frame secured to the back panel and the belt assembly, wherein the bottom portion of the rigid frame has a V-shaped configuration with furthest-apart edges having an angle $\alpha$ at the apex, and in its middle and rear portion, the belt assembly includes an upwardly open pocket having a V-shaped configuration with an inside side edge of angle $\beta$ at the apex, where $\beta$ is greater than $\alpha$, such that said pocket is suitable for serving as a housing for receiving the V-shaped bottom portion of the frame while allowing the belt assembly to pivot angularly relative to the remainder of the rucksack, the inside edges of the upwardly open pocket coming into abutment against the furthest-apart edges of the bottom portion of the rigid frame in order to prevent pivoting beyond an angle $\gamma$ equal to $(\beta-\alpha)/2$.

2. A rucksack according to claim 1, wherein the rigid frame, at least in its V-shaped bottom portion, is constituted by a flat bar of small thickness, and the pocket is a flat pocket applied to the rear face of the belt assembly, in particular by stitching.

3. A rucksack according to claim 2, wherein the bottom end of the frame, forming the V-shaped point presents a rounded shape, and the bottom of the pocket includes, in register with said point, a zone that is reinforced.

4. A rucksack according to claim 1, wherein the middle portion of the belt assembly includes a V-shaped stiffener plate constituting the inside wall of the pocket, said stiffener plate preferably presenting a surface state with a low coefficient of friction relative to the material constituting the V-shaped bottom portion of the frame.

5. A rucksack according to claim 1, which includes releasable fastener means for fastening the belt assembly to the back of the rucksack or to the frame, and serving, in the inactive position, to allow the bottom portion of the frame to be inserted into the V-shaped pocket assembly to the back or to the frame of the rucksack, while not impeding the capacity for the belt assembly to pivot angularly.

6. A rucksack according to claim 5, wherein the fastening means comprises a flexible strip having one end secured, in particular by stitching, to the bottom edge of the back of the rucksack in a middle portion thereof and that can be secured in releasable manner, in particular by self-gripping means of the hook and loop type, to the front face of the belt assembly after the bottom portion of the frame has been placed in the V-shaped pocket.

7. A rucksack according to claim 1, which includes two sets of padding means, and in particular:

a first set constituted by two side pads of the belt assembly disposed on either side of the front wall of the V-shaped pocket, and in particular on either side of its stiffener plate, the inside edges of the two side pads defining a substantially V-shaped space; and a second set constituted by a central pad that is substantially V-shaped, with its bottom portion secured, in particular by stitches, to the bottom edge of the back of the rucksack, said central pad being suitable for engaging in the V-shaped space between the two side pads and including releasable fastener means, in particular self-gripping means, for securing it to the back of the rucksack, in such a manner that during angular pivoting of the belt assembly, the contacting zones of the side pad and of the central pad flatten against each other.

8. A rucksack according to claim 7, wherein the means for fastening the central pad comprises a longitudinal strip extending said central pad and a downwardly-open longitudinal sheath secured to the back of the rucksack and suitable for receiving the longitudinal strip which can be secured releasably to one of the inside faces of said sheath, in particular by self-gripping means.

9. A rucksack according to claim 2, wherein the middle portion of the belt assembly includes a V-shaped stiffener plate constituting the inside wall of the pocket, said stiffener plate preferably presenting a surface state with a low coefficient of friction relative to the material constituting the V-shaped bottom portion of the frame.

10. A rucksack according to claim 3, wherein the middle portion of the belt assembly includes a V-shaped stiffener plate constituting the inside wall of the pocket, said stiffener plate preferably presenting a surface state with a low coefficient of friction relative to the material constituting the V-shaped bottom portion of the frame.

11. A rucksack according to claim 2, which includes releasable fastener means for fastening the belt assembly to the back of the rucksack or to the frame, and serving, in the inactive position, to allow the bottom portion of the frame to be inserted into the V-shaped pocket assembly to the back or to the frame of the rucksack, while not impeding the capacity for the belt assembly to pivot angularly.

12. A rucksack according to claim 3, which includes releasable fastener means for fastening the belt assembly to the back of the rucksack or to the frame, and serving, in the inactive position, to allow the bottom portion of the frame to be inserted into the V-shaped pocket assembly to the back or to the frame of the rucksack, while not impeding the capacity for the belt assembly to pivot angularly.

13. A rucksack according to claim 4, which includes releasable fastener means for fastening the belt assembly to the back of the rucksack or to the frame, and serving, in the inactive position, to allow the bottom portion of the frame to be inserted into the V-shaped pocket assembly to the back or to the frame of the rucksack, while not impeding the capacity for the belt assembly to pivot angularly.

14. A rucksack according to claim 11, wherein the fastening means comprises a flexible strip having one end secured, in particular by stitching, to the bottom edge of the back of the rucksack in a middle portion thereof and that can be secured in releasable manner, in particular by self-gripping means of the hook and loop type, to the front face of the belt assembly after the bottom portion of the frame has been placed in the V-shaped pocket.

15. A rucksack according to claim 12, wherein the fastening means comprises a flexible strip having one end secured, in particular by stitching, to the bottom edge of the back of the rucksack in a middle portion thereof and that can be secured in releasable manner, in particular by self-gripping means of the hook and loop type, to the front face of the belt assembly after the bottom portion of the frame has been placed in the V-shaped pocket.

16. A rucksack according to claim 13, wherein the fastening means comprises a flexible strip having one end secured, in particular by stitching, to the bottom edge of the back of the rucksack in a middle portion thereof and that can be secured in releasable manner, in particular by self-gripping means of the hook and loop type, to the front face of the belt assembly after the bottom portion of the frame has been placed in the V-shaped pocket.

17. A rucksack according to claim 2, which includes two sets of padding means, and in particular:

a first set constituted by two side pads of the belt assembly disposed on either side of the front wall of the V-shaped pocket, and in particular on either side of its stiffener plate, the inside edges of the two side pads defining a substantially V-shaped space; and a second set constituted by a central pad that is substantially V-shaped, with its bottom portion secured, in particular by stitches, to the bottom edge of the back of the rucksack, said central pad being suitable for engaging in the V-shaped space between the two side pads and including releasable fastener means, in particular self-gripping means, for securing it to the back of the rucksack, in such a manner that during angular pivoting of the belt assembly, the contacting zones of the side pad and of the central pad flatten against each other.

18. A rucksack according to claim 3, which includes two sets of padding means, and in particular:

a first set constituted by two side pads of the belt assembly disposed on either side of the front wall of the V-shaped pocket, and in particular on either side of its stiffener plate, the inside edges of the two side pads defining a substantially V-shaped space; and a second set constituted by a central pad that is substantially V-shaped, with its bottom portion secured, in particular by stitches, to the bottom edge of the back of the rucksack, said central pad being suitable for engaging in the V-shaped space between the two side pads and including releasable fastener means, in particular self-gripping means, for securing it to the back of the rucksack, in such a manner that during angular pivoting of the belt assembly, the contacting zones of the side pad and of the central pad flatten against each other.

19. A rucksack according to claim 4, which includes two sets of padding means, and in particular:

a first set constituted by two side pads of the belt assembly disposed on either side of the front wall of the V-shaped pocket, and in particular on either side of its stiffener plate, the inside edges of the two side pads defining a substantially V-shaped space; and a second set constituted by a central pad that is substantially V-shaped, with its bottom portion secured, in particular by stitches, to the bottom edge of the back of the rucksack, said central pad being suitable for engaging in the V-shaped space between the two side pads and including releasable fastener means, in particular self-gripping means, for securing it to the back of the rucksack, in such a manner that during angular pivoting of the belt assembly, the contacting zones of the side pad and of the central pad flatten against each other.

20. A rucksack according to claim 5, which includes two sets of padding means, and in particular:

a first set constituted by two side pads of the belt assembly disposed on either side of the front wall of the V-shaped pocket, and in particular on either side of its stiffener plate, the inside edges of the two side pads defining a substantially V-shaped space; and a second set constituted by a central pad that is substantially V-shaped, with its bottom portion secured, in particular by stitches, to the bottom edge of the back of the rucksack, said central pad being suitable for engaging in the V-shaped space between the two side pads and including releasable fastener means, in particular self-gripping means, for securing it to the back of the rucksack, in such a manner that during angular pivoting of the belt assembly, the contacting zones of the side pad and of the central pad flatten against each other.

* * * * *